US008587507B2

(12) United States Patent
Hasegawa et al.

(10) Patent No.: US 8,587,507 B2
(45) Date of Patent: Nov. 19, 2013

(54) DRIVING CIRCUIT AND DISPLAY APPARATUS HAVING OPERATIONAL AMPLIFIERS WITH PARASITIC DIODES

(75) Inventors: Hideaki Hasegawa, Ibaraki (JP); Atsushi Hirama, Tokyo (JP); Koji Higuchi, Ibaraki (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 269 days.

(21) Appl. No.: 13/164,838

(22) Filed: Jun. 21, 2011

(65) Prior Publication Data

US 2012/0001952 A1 Jan. 5, 2012

(30) Foreign Application Priority Data

Jul. 5, 2010 (JP) ..... 2010-152957

(51) Int. Cl.
*G09G 3/36* (2006.01)

(52) U.S. Cl.
USPC ..... 345/96; 345/209

(58) Field of Classification Search
USPC ..... 345/209, 96
See application file for complete search history.

(56) References Cited

U.S. PATENT DOCUMENTS

| | | | | |
|---|---|---|---|---|
| 2005/0206602 | A1* | 9/2005 | Kojima | 345/96 |
| 2007/0126722 | A1* | 6/2007 | Hashimoto | 345/204 |
| 2009/0231319 | A1* | 9/2009 | Tsuchi | 345/211 |
| 2010/0148875 | A1* | 6/2010 | Augustyniak et al. | 330/291 |
| 2011/0141098 | A1* | 6/2011 | Yaguma et al. | 345/212 |

FOREIGN PATENT DOCUMENTS

| | | |
|---|---|---|
| JP | 10-062744 | 3/1998 |
| JP | 2005-266738 | 9/2005 |
| JP | 2006-292807 | 10/2006 |

* cited by examiner

*Primary Examiner* — Chanh Nguyen
*Assistant Examiner* — Long D Pham
(74) *Attorney, Agent, or Firm* — Volentine & Whitt, PLLC

(57) ABSTRACT

A driving circuit includes a pair of operational amplifiers, one producing an analog voltage output of positive polarity, the other producing an analog voltage output of negative polarity. An output switching circuit interchanges these outputs between a pair of data lines. One or both of the operational amplifiers includes a parasitic diode having one terminal connected to the output terminal of the operational amplifier and another terminal normally connected to a power supply voltage of the operational amplifier. When the output of the operational amplifier is switched, a protective switching circuit temporarily disconnects the parasitic diode from the power supply of the operational amplifier and instead connects it to a power supply line carrying a voltage high enough, or low enough, to ensure that the parasitic diode is not forward biased by the existing voltage on the data line to which the output is switched.

19 Claims, 11 Drawing Sheets

DRIVING CIRCUIT AND DISPLAY APPARATUS HAVING OPERATIONAL AMPLIFIERS WITH PARASITIC DIODES

BACKGROUND OF THE INVENTION

1. Field of the Invention

The present invention relates to a driving circuit, more particularly an AC driving circuit, for driving a display panel such as a liquid crystal display panel, and to a display apparatus using the driving circuit.

2. Description of the Related Art

A liquid crystal display panel of the active matrix type has a matrix of pixels, each of which includes a liquid crystal layer and an active element such as a thin-film transistor (TFT) for controlling the electric field applied to the liquid crystal layer. The driving circuit includes a gate driver and a source driver. The gate driver supplies control signals through scan lines (gate lines) to control the on/off-state of each active element. The source driver applies analog gray-scale voltages through data lines (source lines) to pixel electrodes. The liquid crystal layer of each display pixel is sandwiched between a pixel electrode on one side and an opposing electrode on the opposite side. An AC driving method is widely used, in which the polarity of the gray-scale voltage is reversed periodically, typically once per frame or field in the image signal. The resulting periodic reversal of the direction of the electric field applied to the liquid crystal layer prevents the degradation of the liquid crystal layer that would occur if a gray-scale voltage including a DC voltage component of constant polarity were to be applied continuously. In a variation of the AC driving method referred to as dot inversion, the gray-scale voltage reverses between positive and negative polarity at every pixel (dot), or every few pixels. In another variation referred to as line inversion, the gray-scale voltage reverses between positive and negative polarity in alternate scan lines or data lines.

When the AC driving method is used in the source driver, the source driver typically has an impedance conversion circuit including two operational amplifiers connectable to each data (source) line. One operational amplifier (referred to below as the high-side operational amplifier) outputs an analog gray-scale voltage of positive polarity; the other operational amplifier (referred to below as the low-side operational amplifier) outputs an analog gray-scale voltage of negative polarity. Source drivers having such impedance conversion circuits are disclosed in Japanese Patent Application Publication Nos. 2006-292807, 1998-062744, and 2005-266738.

A problem that occurs in a source driver operating by the AC driving method will be described below with reference to the schematic circuit diagram of part of a source driver in FIG. 1. The impedance conversion circuit 100 in FIG. 1 includes a low-side operational amplifier 100A and a high-side operational amplifier 100B. The low-side operational amplifier 100A is a non-inverting amplifier powered by a power supply voltage VSS and a common power supply voltage VMM higher than the power supply voltage VSS. The high-side operational amplifier 100B is a non-inverting amplifier powered by the common power supply voltage VMM and a power supply voltage VDD higher than the common power supply voltage VMM. The low-side operational amplifier 100A outputs an analog gray-scale voltage of negative polarity (equal to or lower than the common voltage VMM) from an output terminal NA. The high-side operational amplifier 100B outputs an analog gray-scale voltage of positive polarity (equal to or higher than VMM) from an output terminal NB.

As shown in FIG. 1, the output terminal NA of the low-side operational amplifier 100A and the output terminal NB of the high-side operational amplifier 100B are connected through an output switching circuit 200 to a pair of data lines 31A, 31B. The output switching circuit 200 has switches 201, 202, 203, 204 that open and close responsive to switch control signals Sa, Sb, Sc, Sd. Switch control is performed so that when switches 201, 204 are in the on-state, switches 202, 203 are in the off-state, and when switches 201, 204 are in the off-state, switches 202, 203 are in the on-state.

During the transition from one image display period (for example, frame period or field period) $T_i$ to the next image display period $T_{1+1}$, switches 201, 204 are switched from the on-state to the off-state and switches 202, 203 are switched from the off-state to the on-state. This switchover connects data line 31A, which had been receiving an analog gray-scale voltage of negative polarity and is still at a relatively low voltage level, to the output terminal NB of the high-side operational amplifier 100B, so the voltage level at this output terminal NB may temporarily drop below the common power supply voltage VMM. At the same time data line 31B, which had been receiving an analog gray-scale voltage of positive polarity and is still at a relatively high voltage level, is connected to the output terminal NA of the low-side operational amplifier 100A, so the voltage level at this output terminal NA rises and may temporarily exceed the common power supply voltage VMM. As a result, parasitic diodes 101*a*, 101*b* present inside the operational amplifiers 100A, 100B may become forward biased and allow excessive current to flow, possibly damaging the operational amplifiers 100A, 100B.

SUMMARY OF THE INVENTION

In view of the foregoing, it is an object of the present invention to provide a driving circuit capable of preventing excessive current from occurring in any of the operational amplifiers, and a display apparatus using the driving circuit.

According to an aspect of the present invention, there is provided a driving circuit for driving a display panel having a plurality of signal lines, a plurality of data lines spaced apart from the plurality of signal lines but arrayed to cross the plurality of signal lines, and a plurality of capacitive loads formed in respective areas neighboring crossings of the signal lines and the data lines. The driving circuit includes:

a first operational amplifier powered by a first power supply voltage and a second power supply voltage lower than the first power supply voltage, having an output terminal for output of an analog voltage with a direct current voltage component of positive polarity;

a second operational amplifier powered by a third power supply voltage and a fourth power supply voltage lower than the third power supply voltage, having an output terminal for output of an analog voltage with a direct current voltage component of negative polarity; and an output switching circuit for connecting the output terminal of the first operational amplifier to a first data line among the plurality of data lines and connecting the output terminal of the second operational amplifier to a second data line among the plurality of data lines, then interchanging connections so that the output terminal of the first operational amplifier is connected to the second data line and the output terminal of the second operational amplifier is connected to the first data line.

The first operational amplifier includes:

a first parasitic diode having an anode connected to a power line supplying the second power supply voltage and a cathode connected to the output terminal of the first operational amplifier; and a first protective switching circuit for connecting the anode of the first parasitic diode to a first voltage supply line supplying a voltage lower than the second supply voltage when the output switching circuit switches the connection of the output terminal of the first operational amplifier from the first data line to the second data line.

Alternatively, the second operational amplifier includes:

a second parasitic diode having a cathode connected to a power line supplying the third power supply voltage and an anode connected to the output terminal of the second operational amplifier, and a second protective switching circuit for connecting the cathode of the second parasitic diode to a second voltage supply line supplying a voltage higher than the third supply voltage when the output switching circuit switches the connection of the output terminal of the second operational amplifier from the second data line to the first data line.

Both the first and second operational amplifiers may have the configurations described above.

According to another aspect of the present invention, there is provided a display apparatus including a driving circuit of the type above.

The protective switching circuits in the driving circuit prevent the parasitic diodes from becoming forward biased, thereby preventing the flow of destructive currents in the operational amplifiers.

DETAILED DESCRIPTION OF THE INVENTION

Figure 1:
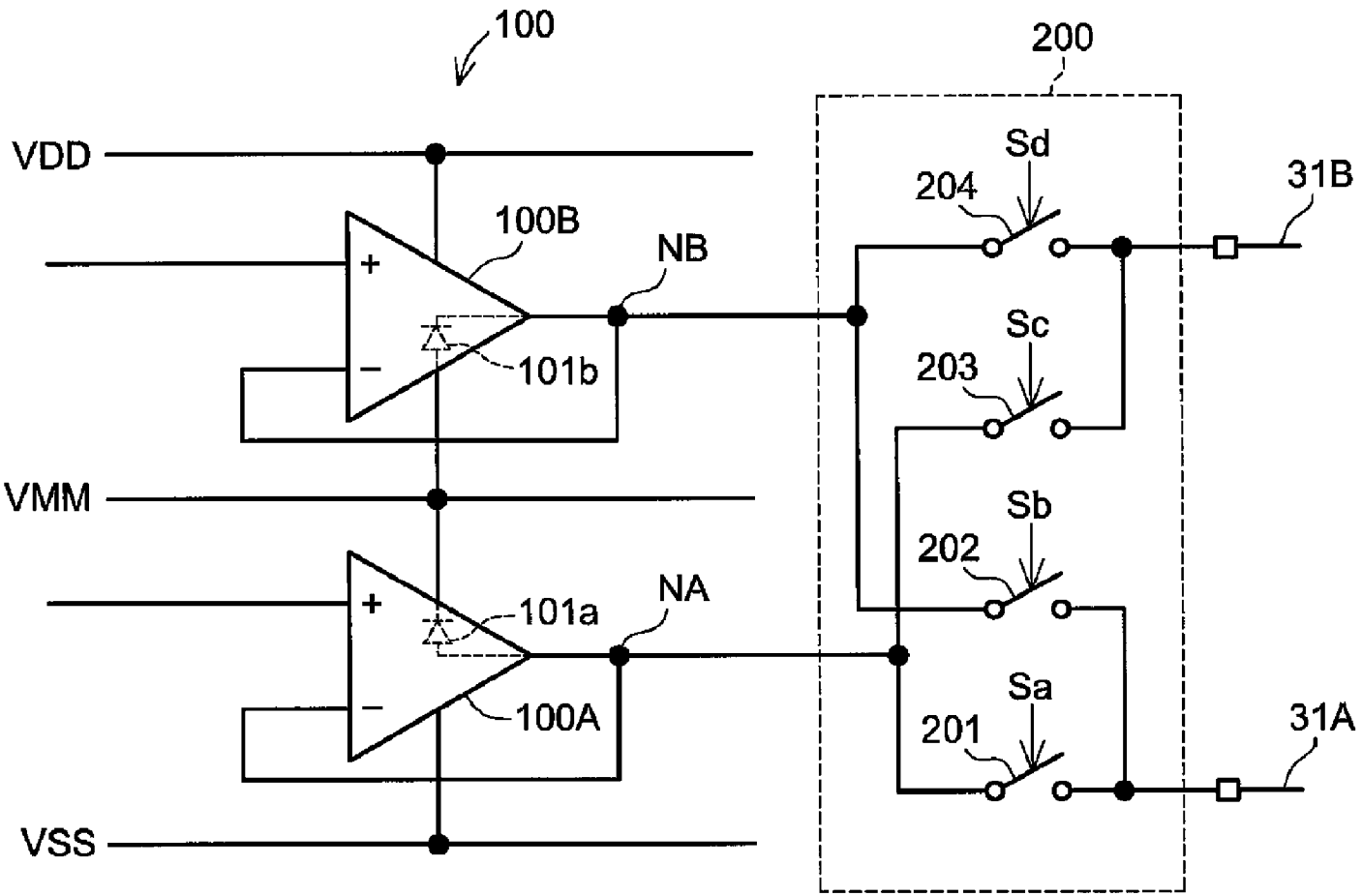
FIG. 1 RELATED ART
FIG. 1 is a schematic circuit diagram of an impedance conversion and switching circuit in a conventional source driver.

Embodiments of the invention will now be described with reference to the attached drawings, in which like elements are indicated by like reference characters.

First Embodiment

Figure 2:
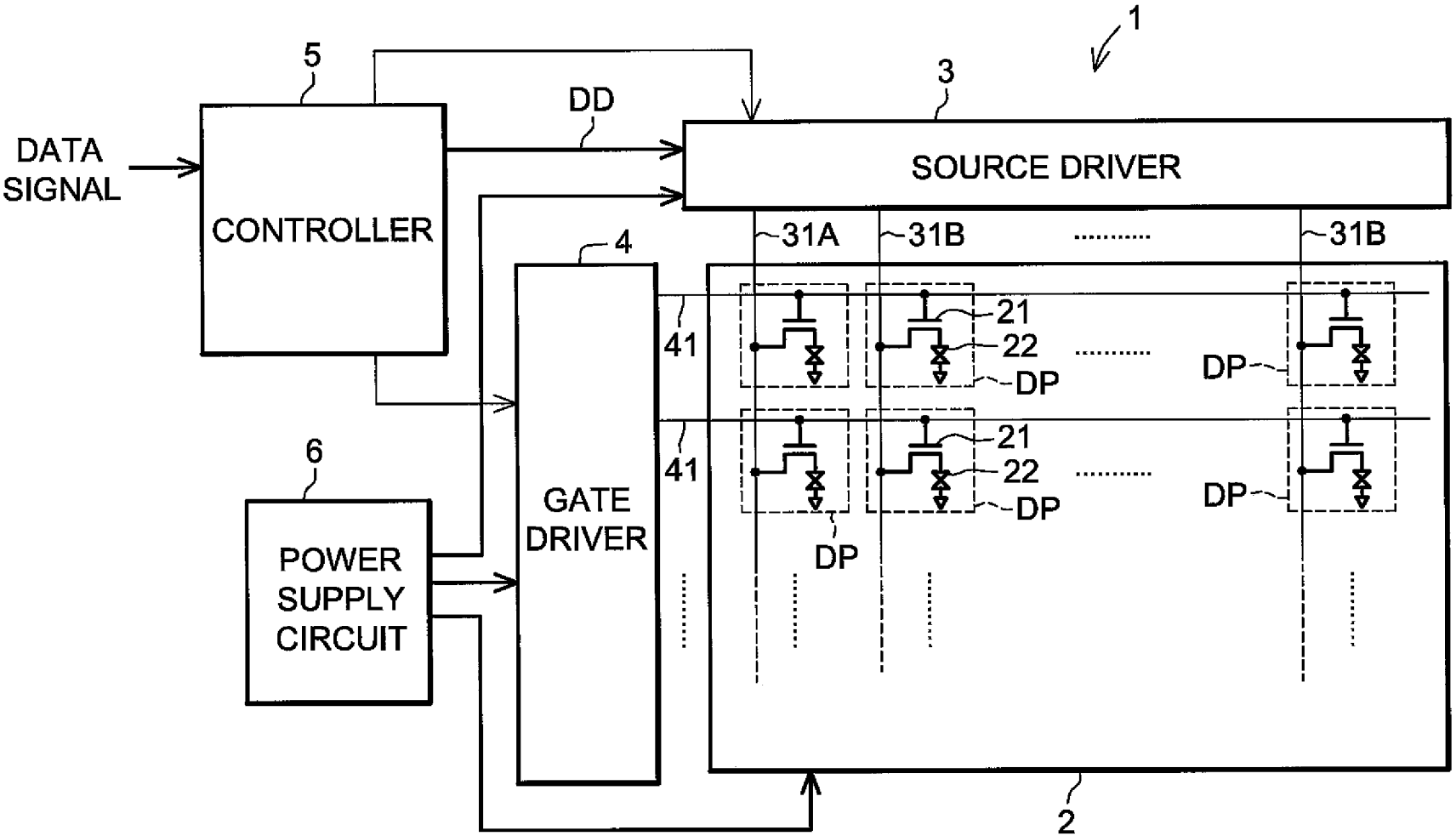
FIG. 2 is a schematic functional block diagram showing the circuit configuration of a liquid crystal display device.

Referring to FIG. 2, the first embodiment is a liquid crystal display device 1 including a liquid crystal display panel 2, a source driver 3, a gate driver 4, a controller 5, and a power supply circuit 6. The controller 5 controls the operation of the source driver 3 and gate driver 4.

The liquid crystal display panel 2 has a backlight unit (not shown), mutually parallel scan lines (gate lines) 41, and data lines (source lines) 31A, 31B spaced apart from the scan lines 41 but arrayed to cross the scan lines 41. In FIG. 2, odd-numbered data lines are indicated by reference characters 31A and even-numbered data lines by reference characters 31B. Display pixels DP are located in the neighborhood of the crossings of the data lines 31A, 31B and the scan lines 41. The display pixels DP are arranged two-dimensionally. Each display pixel DP includes a liquid crystal display element 22 sandwiched between a pixel electrode and an opposing electrode and functioning as a capacitive load, and an active element 21 such as a TFT for controlling the application of an electric field to the liquid crystal display element 22. One main terminal of the active element 21 is connected to the pixel electrode, and a common voltage supplied from the power supply circuit 6 is applied to the opposing electrode. The other main terminal of the active element 21 is connected to a data line 31A or 31B. The control terminal (gate) of the active element 21 is connected to one of the scan lines 41.

The controller 5 performs image processing on a data signal supplied from an external signal source (not shown) to generate digital data DD, which are output to the source driver 3 one horizontal display line at a time. The gate driver 4 sequentially outputs pulse voltages to the scan lines 41 to bring the active elements 21 into the on-state. The source driver 3 converts the digital data DD to analog gray-scale voltages (referred to below simply as gray-scale voltages), performs an impedance conversion on the gray-scale voltages, and outputs the converted gray-scale voltages in parallel to the data lines 31A, 31B, thereby enabling the gray-scale voltages to be applied to the pixel electrodes of the liquid crystal display elements 22 connected to the active elements 21 that are in the on-state. Each display pixel DP stores and holds the applied gray-scale voltage. As a result, an electric field corresponding to the voltage difference between the gray-scale voltage and the common voltage is created between the pixel electrode and the opposing electrode of the liquid crystal display element 22. The liquid crystal molecules in the liquid crystal display element 22 orient themselves in accordance with this electric field. The light transmissivity of the liquid crystal display element 22 varies according to the orientation of the liquid crystal molecules.

Figure 3:
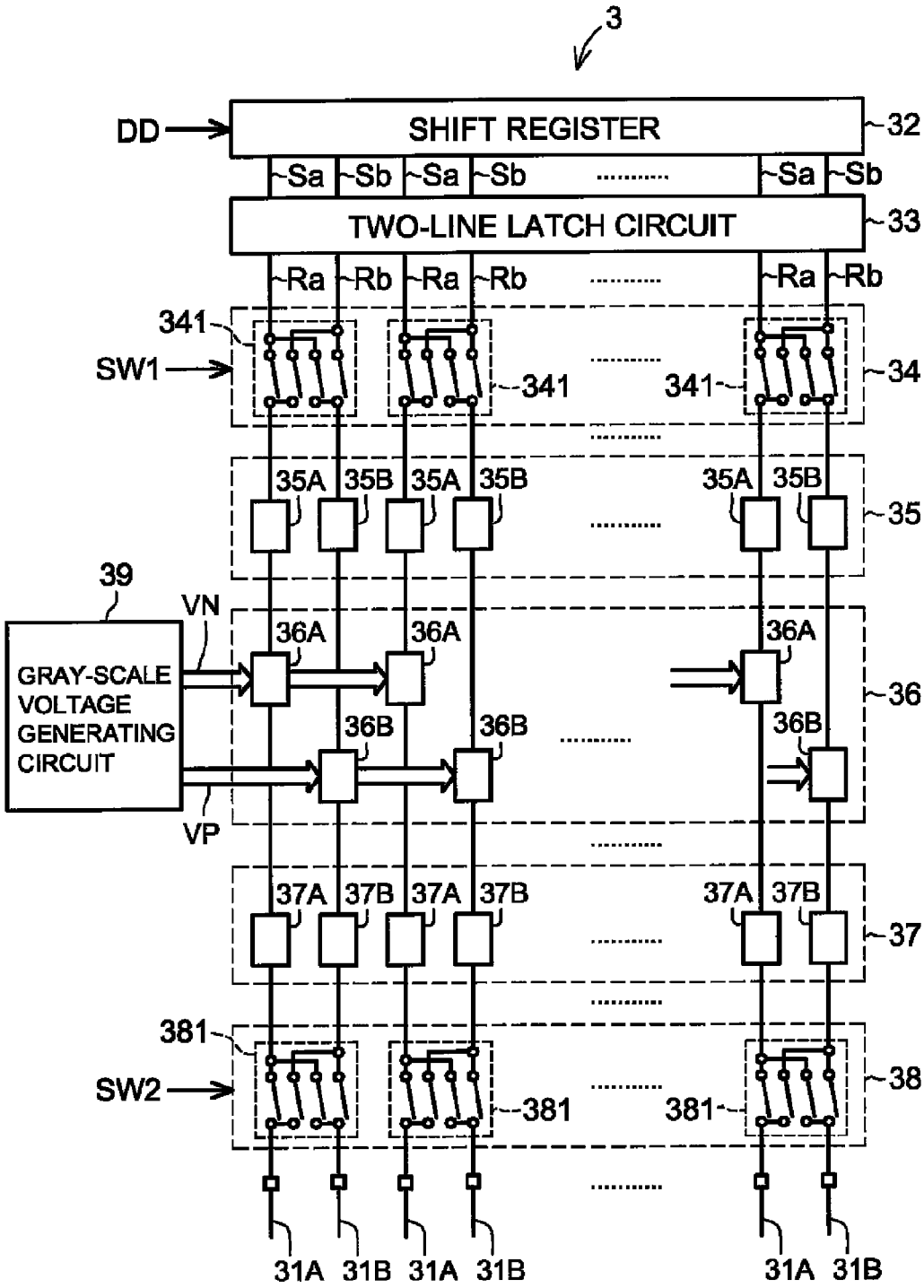
FIG. 3 schematically shows an exemplary circuit configuration of the source driver in FIG. 2 according to a first embodiment of the invention.

Referring to FIG. 3, the source driver 3 has a shift register 32, a two-line latch circuit 32, a line switching circuit 34, a level shifting circuit 35, a voltage conversion circuit 36, an impedance conversion circuit 37, another line switching circuit 38, and a gray-scale voltage generating circuit 39.

Figure 4:
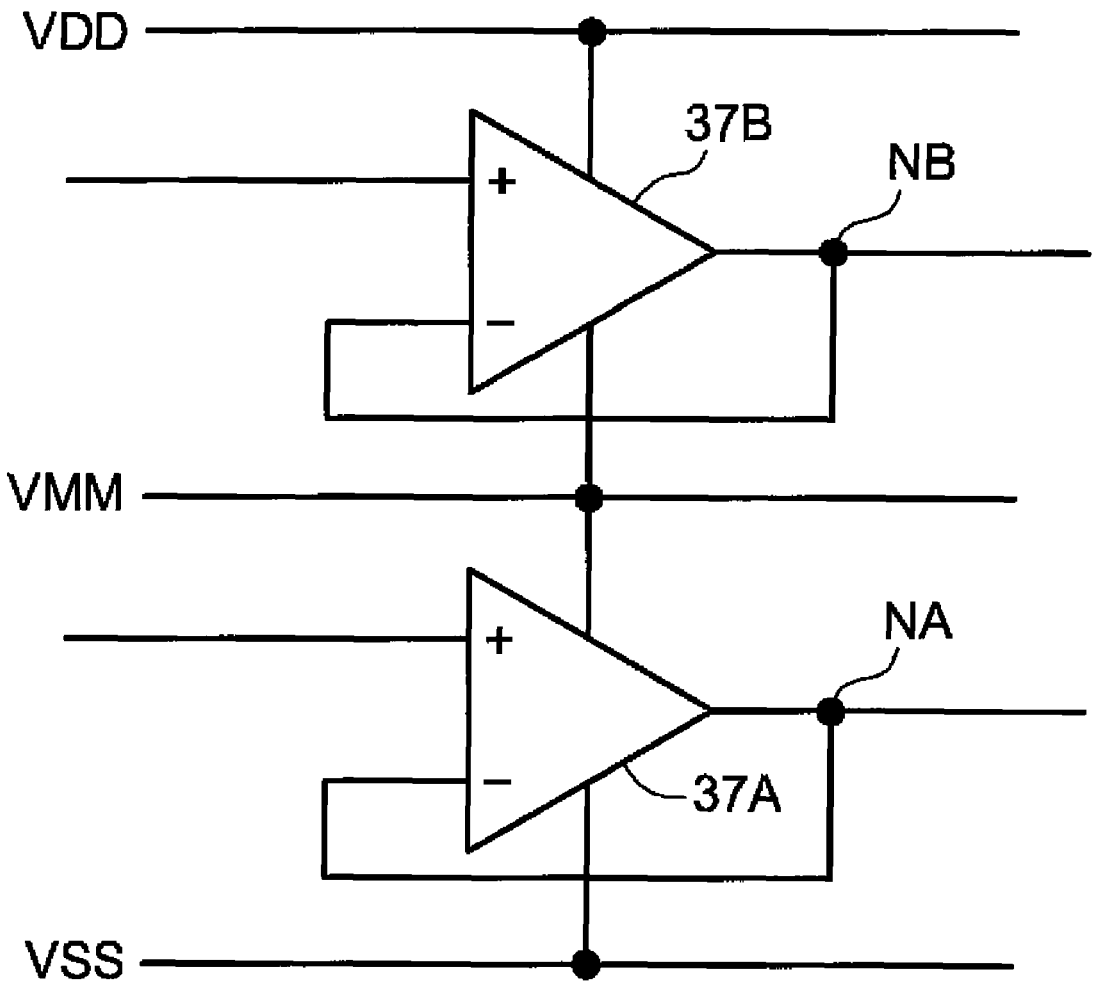
FIG. 4 is a circuit diagram illustrating the feedback and power supply connections of a pair of operational amplifiers in the source driver in FIG. 3.

The impedance conversion circuit 37 includes a plurality of paired operational amplifiers 37A, 37B of the voltage-follower type. Referring to FIG. 4, each pair of operational amplifiers includes a non-inverting high-side operational amplifier 37B powered by a power supply voltage VDD and a common power supply voltage VMM lower than the power supply voltage VDD, and a non-inverting low-side operational amplifier 37A powered by the common power supply voltage VMM and a power supply voltage VSS lower than the common power supply voltage VMM.

The shift register 32 in FIG. 3 receives digital data (multi-valued gray-scale data) DD transferred serially from the controller 5 and outputs the digital data for one horizontal display line in parallel to the two-line latch circuit 32 via wiring lines Sa, Sb that correspond one-to-one to the data lines 31A, 31B. Reference characters Sa indicate wiring lines corresponding to the odd-numbered data lines 31A; reference characters Sb indicate wiring lines corresponding to the even-numbered data lines 31B. The two-line latch circuit 32 latches the parallel outputs from the shift register 32 and outputs the latched data in parallel to line switching circuit 34 via wiring lines Ra, Rb that correspond one-to-one to wiring lines Sa, Sb.

Line switching circuit 34 includes one output switching circuit 341 for each pair of wiring lines Ra, Rb. All of the output switching circuits 341 operate according to a control signal SW1 from the controller 5. The level shifting circuit 35 following line switching circuit 34 has level shifters 35A for use with gray-scale voltages of negative polarity paired with level shifters 35B for use with gray-scale voltages of positive polarity. Each output switching circuit 341 connects one pair of wiring lines Ra, Rb to one pair of level shifters 35A, 35B. At some timings, wiring lines Ra is connected to level shifter 35A and wiring line Rb to level shifter 35B, thereby supplying the signal transmitted through wiring line Ra to level shifter 35A and the signal transmitted through the wiring line Rb to level shifter 35B. This connection mode of the output switching circuit 341 will be referred to below as a straight connection. At other timings, wiring line Ra is connected to level shifter 35B and wiring line Rb to level shifter 35A, thereby supplying the signal transmitted through wiring line Ra to level shifter 35B and the signal transmitted through wiring line Rb to level shifter 35A. This connection mode of the output switching circuit 341 will be referred to below as a cross connection.

The gray-scale voltage generating circuit 39 generates, from a voltage supplied from the power supply circuit 6, a gray-scale voltage group VP of positive polarity having $2^N$ (N is an integer) levels higher than a reference voltage (for example, the VMM voltage level) and another gray-scale voltage group VN of negative polarity having $2^N$ levels lower than the reference voltage, and supplies the generated voltage groups to the voltage conversion circuit 36. When an eight-bit gray scale is used, for example, the gray-scale voltages of positive polarity have $2^8$ (=256) levels and the gray-scale voltages of negative polarity have $2^8$ (=256) levels. In the voltage conversion circuit 36, gray-scale voltage selectors 36A select, from the gray-scale voltage group VN of negative polarity, gray-scale voltages corresponding to the outputs of level shifters 35A and supply the selected gray-scale voltages to the low-side operational amplifiers 37A; gray-scale voltage selectors 36B select, from the gray-scale voltage group VP of positive polarity, gray-scale voltages corresponding to the outputs of level shifters 35B and supply the selected gray-scale voltages to the high-side operational amplifiers 37B.

Line switching circuit 38 includes one output switching circuit 381 for each pair of operational amplifiers 37A, 37B. The output switching circuits 381 operate according to a control signal SW2 supplied from the controller 5. When the output switching circuits 341 are in the straight connection mode, the output switching circuits 381 also operate in the straight connection mode, connecting the output terminals of the low-side operational amplifiers 37A to the odd-numbered data lines 31A and the output terminals of the high-side operational amplifiers 37B to the even-numbered data lines 31B. In this mode, gray-scale voltages of negative polarity are applied to data lines 31A and gray-scale voltages of positive polarity are applied to data lines 31B. When output switching circuits 341 are in the cross connection mode, output switching circuits 381 also operate in the cross connection mode, connecting the output terminals of the low-side operational amplifiers 37A to the even-numbered data lines 31B and the output terminals of the high-side operational amplifiers 37B to the odd-numbered data lines 31A. In this mode gray-scale voltages of positive polarity are applied to data lines 31A and gray-scale voltages of negative polarity are applied to data lines 31B.

Figure 5A:
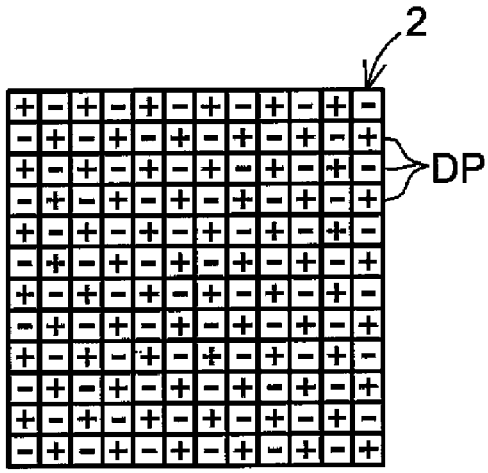
FIGS. 5A and 5B illustrate a dot inversion driving scheme.
Figure 5B:
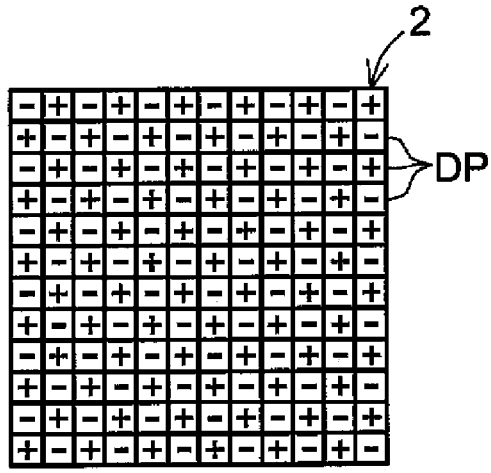
Figure 6A:
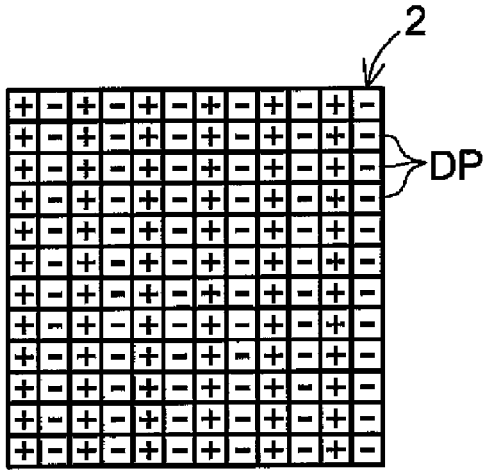
FIGS. 6A and 6B illustrate a line inversion driving scheme.
Figure 6B:
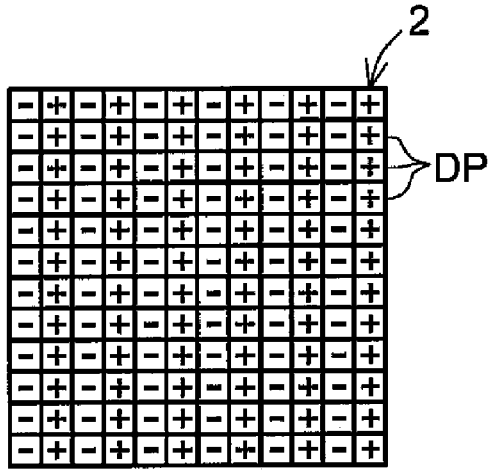

The connection modes of the output switching circuits 341, 381 in the line switching circuits 34, 38 can be switched to implement various AC driving schemes for the liquid crystal display panel 2. FIGS. 5A and 5B illustrate a dot inversion driving scheme. FIGS. 6A and 6B illustrate a line inversion driving scheme. A plus sign (+) in these drawings indicates that the display pixel DP holds a gray-scale voltage of positive polarity, and a minus sign (−) indicates that the display pixel DP holds a gray-scale voltage of negative polarity.

In FIGS. 5A and 5B, horizontally adjacent display pixels DP hold gray-scale voltages of differing polarities, and vertically adjacent display pixels DP also hold gray-scale voltages of differing polarities. The states in FIGS. 5A and 5B are switched at, for example, alternate frames or fields. In FIGS. 6A and 6B, vertically adjacent display pixels DP hold gray-scale voltages of identical polarity, but horizontally adjacent display pixels DP hold gray-scale voltages of differing polarities. The states in FIGS. 6A and 6B are switched at, for example, alternate frames or fields.

Figure 7:
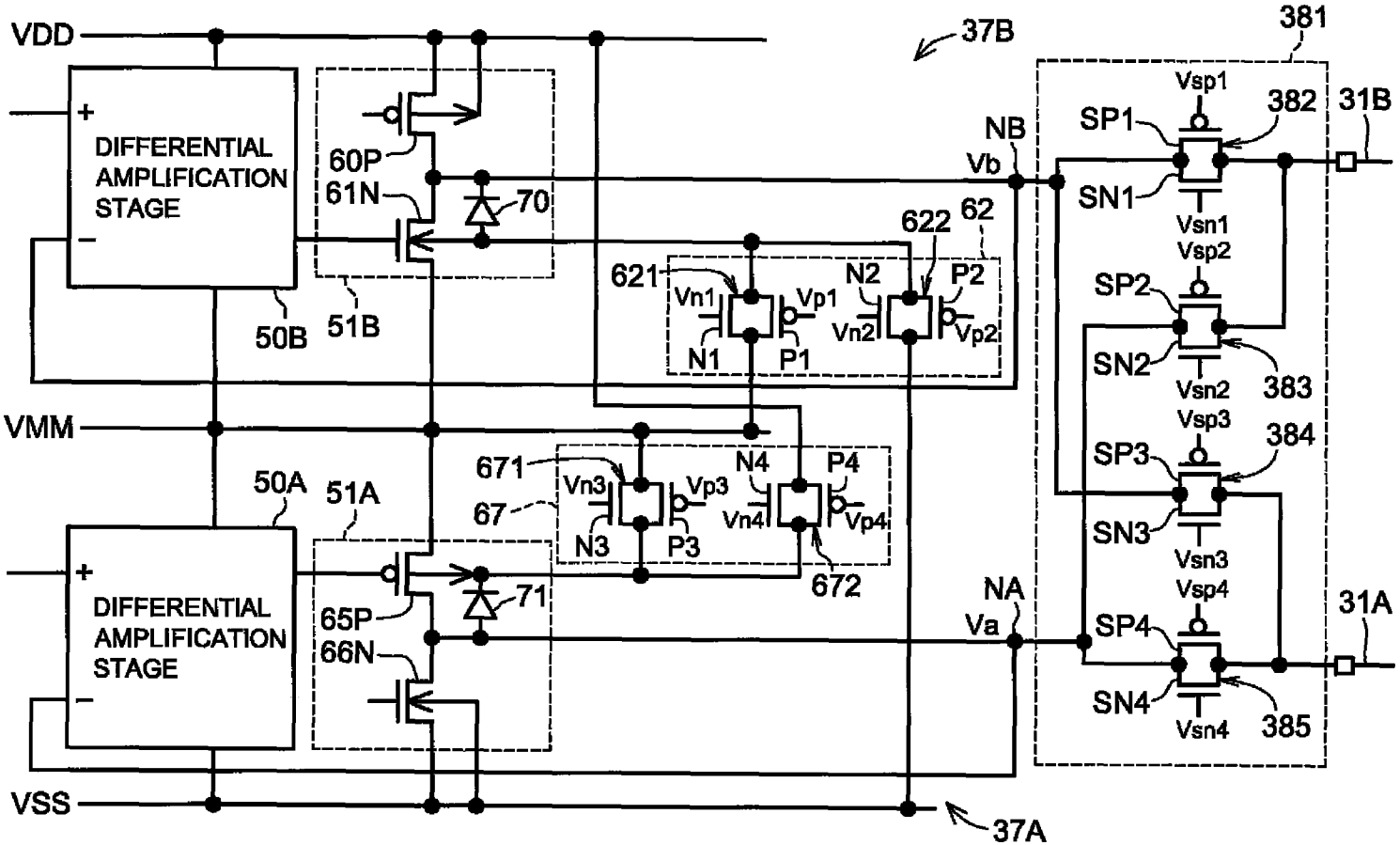
FIG. 7 illustrates the circuit configuration of a pair of operational amplifiers and their output switching circuit in the source driver in FIG. 3.

Referring to FIG. 7, each high-side operational amplifier 37B includes a differential amplification stage 50B, an output amplification stage 51B, and a protective switching circuit 62. The output terminal (node) NB of the high-side operational amplifier 37B is connected to the inverting input terminal (−) of the differential amplification stage 50B.

Incidentally, the input terminals of the differential amplification stages 50A, 50B in FIGS. 7, 9, 11, and 12 are inverting and non-inverting with respect to the outputs of the output amplification stages 51A, 51B.

Output amplification stage 51B in FIG. 7 includes a p-channel field effect transistor (PMOS transistor) 602 and an n-channel field effect transistor (NMOS transistor) 61N. NMOS transistor 61N has a gate connected to the output terminal of differential amplification stage 50B, a source connected to a power line for supplying the common power supply voltage VMM (referred to below as a VMM power supply line), and a drain connected to the output terminal NB. A parasitic pn junction diode 70 is formed between the back gate (the substrate region below the gate) and drain of NMOS transistor 61N. PMOS transistor 602 has a source connected to a power line for supplying the power supply voltage VDD (referred to below as a VDD power supply line), a drain connected to the drain of NMOS transistor 61N, and a gate to which a constant voltage is supplied. The back gate of PMOS transistor 60P is connected to the VDD power supply line. PMOS transistor 60P operates as a constant current source.

Differential amplification stage 50B may have a conventional internal configuration (not shown), or any suitable configuration.

The protective switching' circuit 62 includes a pair of MOS switches 621, 622.

MOS switch 621 consists of a pair of PMOS and NMOS transistors. PMOS transistor P1 is brought into the conductive state (on-state) or the non-conductive state (off-state) according to the level of its gate voltage (control voltage) Vp1; NMOS transistor N1 is brought into the conductive state (on-state) or the non-conductive state (off-state) according to the level of its gate voltage (control voltage) Vn1. One main terminal of MOS switch 621 is connected to the back gate of NMOS transistor 61N (that is, to the anode of parasitic diode 70), and the other main terminal of MOS switch 621 is connected to the VMM power supply line.

MOS switch 622 consists of another pair of PMOS and NMOS transistors. PMOS transistor P2 is brought into the conductive state (on-state) or the non-conductive state (off-state) according to the level of its gate voltage (control voltage) Vp2; NMOS transistor N2 is brought into the conductive state (on-state) or the non-conductive state (off-state) according to the level of its gate voltage (control voltage) Vn2. One main terminal of MOS switch 622 is connected to the back gate of NMOS transistor 61N (that is, to the anode of parasitic diode 70), and the other main terminal of MOS switch 622 is connected to a power line for supplying the power supply voltage VSS (referred to below as a VSS power supply line).

The controller 5 in FIG. 2 supplies gate voltages Vn1, Vp1, Vn2, Vp2 to the protective switching circuit 62 as switch control signals.

Similarly, the low-side operational amplifier 37A in FIG. 7 includes a differential amplification stage 50A, an output amplification stage 51A, and a protective switching circuit 67. The output terminal (node) NA of the low-side operational amplifier 37A is connected to the inverting input terminal (−) of the differential amplification stage 50A.

Output amplification stage 51A includes a PMOS transistor 65P and an NMOS transistor 66N. PMOS transistor 65P has a gate connected to the output terminal of the differential amplification stage 50A, a source connected to the VMM power supply line, and a drain connected to the output terminal NA. A parasitic pn junction diode 71 is formed between the back gate and drain of PMOS transistor 652. NMOS transistor 66N has a source connected to the VSS power supply line, a drain connected to the drain of PMOS transistor 65P, and a gate to which a constant voltage is supplied. The back gate of NMOS transistor 66N is connected to the VSS power supply line. NMOS transistor 66N operates as a constant current source. Differential amplification stage 50A may have a conventional internal circuit configuration (not shown), or any suitable configuration.

Protective switching circuit 67 includes a pair of MOS switches 671, 672.

MOS switch 671 consists of a pair of PMOS and NMOS transistors. PMOS transistor P3 is brought into the conductive state (on-state) or the non-conductive state (off-state) according to the level of its gate voltage (control voltage) Vp3; NMOS transistor N3 is brought into the conductive state (on-state) or the non-conductive state (off-state) according to the level of its gate voltage (control voltage) Vn3. One main terminal of MOS switch 671 is connected to the back gate of PMOS transistor 65P (that is, to the cathode of parasitic diode 71), and the other main terminal of MOS switch 671 is connected to the VMM power supply line.

MOS switch 672 likewise consists of a pair of PMOS and NMOS transistors. PMOS transistor P4 is brought into the conductive state (on-state) or the non-conductive state (off-state) according to the level of its gate voltage (control voltage) Vp4; NMOS transistor N4 is brought into the conductive state (on-state) or the non-conductive state (off-state) according to the level of its gate voltage (control voltage) Vn4. One main terminal of MOS switch 672 is connected to the back gate of PMOS transistor 65P (that is, to the cathode of parasitic diode 71), and the other main terminal of MOS switch 672 is connected to the VDD power supply line.

The controller 5 in FIG. 2 supplies gate voltages Vn3, Vp3, Vn4, Vp4 . . . to protective switching circuit 67 as switch control signals.

The output switching circuit 381 in FIG. 7 includes first to fourth MOS switches 382, 383, 384, 385. MOS switch 382 consists of a pair of PMOS and NMOS transistors SP1, SN1. PMOS transistor SP1 is brought into the conductive state (on-state) or the non-conductive state (off-state) according to the level of its gate voltage (control voltage) Vsp1. NMOS transistor SN1 is brought into the conductive state (on-state) or the non-conductive state (off-state) according to the level of its gate voltage (control voltage) Vsn1. MOS switch 383 consists of a pair of PMOS and NMOS transistors SP2, SN2. PMOS transistor SP2 is brought into the conductive state (on-state) or the non-conductive state (off-state) according to the level of its gate voltage (control voltage) Vsp2. NMOS transistor SN2 is brought into the conductive state (on-state) or the non-conductive state (off-state) according to the level of its gate voltage (control voltage) Vsn2. MOS switch 384 consists of a pair of PMOS and NMOS transistors SP3, SN3. PMOS transistor SP3 is brought into the conductive state (on-state) or the non-conductive state (off-state) according to the level of its gate voltage (control voltage) Vsp3. NMOS transistor SN3 is brought into the conductive state (on-state) or the non-conductive state (off-state) according to the level of its gate voltage (control voltage) Vsn3. MOS switch 385 consists of a pair of PMOS and NMOS transistors SP4, SN4. PMOS transistor SP4 is brought into the conductive state (on-state) or the non-conductive state (off-state) according to the level of its gate voltage (control voltage) Vsp4. NMOS transistor SN4 is brought into the conductive state (on-state) or the non-conductive state (off-state) according to the level of its gate voltage (control voltage) Vsn4.

The controller 5 in FIG. 2 supplies gate voltages Vsp1, Vsn1, Vsp2, Vsn2, Vsp3, Vsn3, Vsp4, Vsn4 to output switching circuit 381 and thereby controls its connection modes. When output switching circuit 381 is in the straight connection mode, MOS switches 382, 385 are in the conductive state and MOS switches 383, 384 are in the non-conductive state, so output terminal NB is connected to data line 31B and output terminal NA is connected to data line 31A. When output switching circuit 381 is in the cross connection mode, MOS switches 383, 384 are in the conductive state and MOS switches 382, 385 are in the non-conductive mode, so output terminal NA is connected to data line 31B and output terminal NB is connected to data line 31A.

Figure 8:
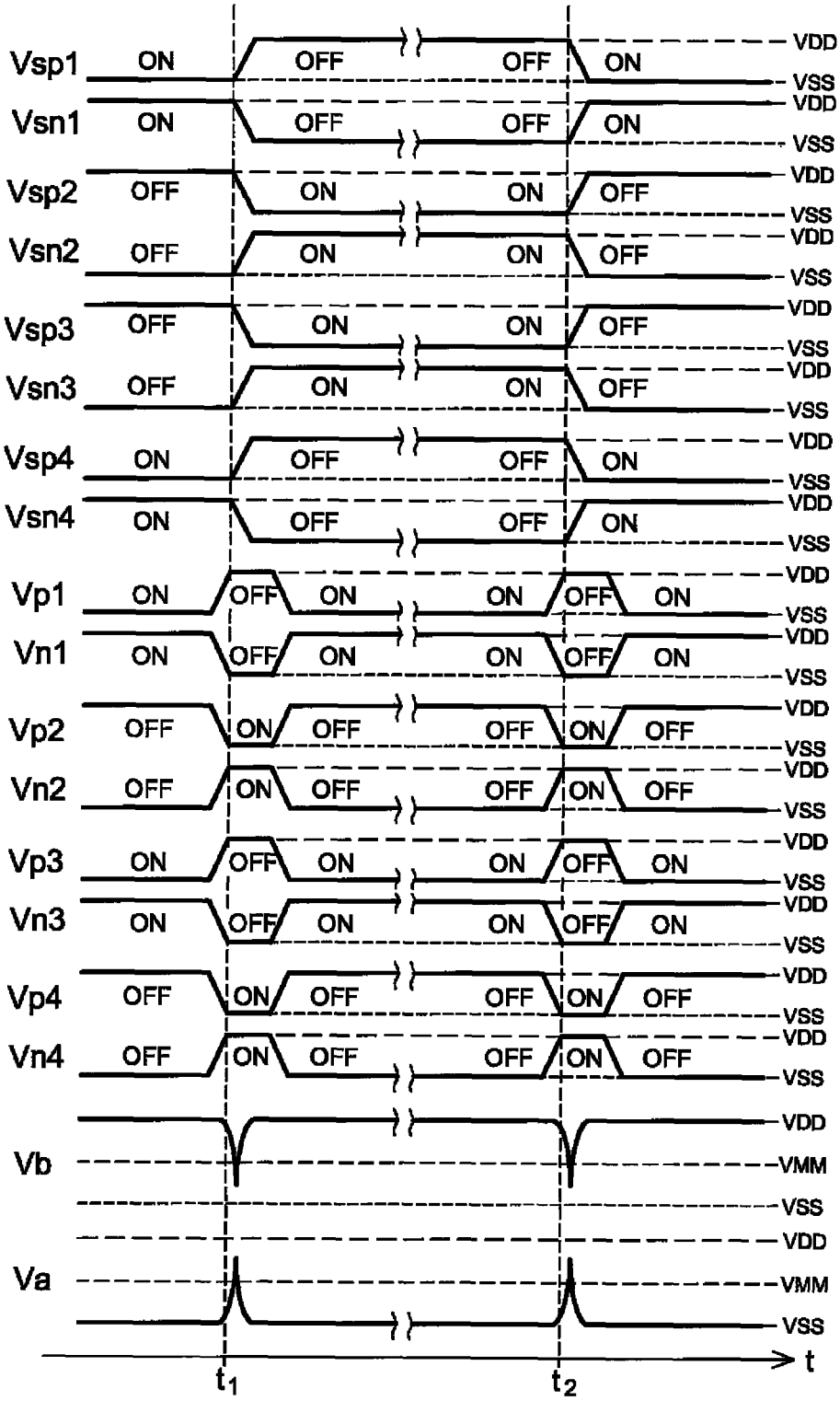
FIG. 8 is a timing diagram illustrating control signal waveforms when the outputs of the operational amplifiers in FIG. 7 are switched.

The waveforms of the gate voltages Vsp1, Vsn1, Vsp2, Vsn2, Vsp3, Vsn3, Vsp4, Vsn4 supplied to output switching circuit 381, the waveforms of the gate voltages Vp1, Vn1, Vp2, Vn2, Vp3, Vn3, Vp4, Vn4 supplied to the protective switching circuits 62, 67, and the voltage levels Va, Vb at the output terminals NA, NB are shown in FIG. 8.

When the connection mode of output switching circuit 381 is switched from straight connection to cross connection (at around time t1), as shown in the waveforms in FIG. 8, the supplied gate voltages Vsp1, Vsn1, Vsp4, Vsn4 bring MOS switches 382, 385 from the conductive state into the non-conductive state. That is, the gate voltages Vsp1, Vsp4 of PMOS transistors SP1, SP4 are driven high and the gate voltages Vsn1, Vsn4 of NMOS transistors SN1, SN4 are driven low. At the same time, gate voltages Vsp2, Vsn2, Vsp3, Vsn3 that bring MOS switches 383, 384 from the non-conductive state into the conductive state are supplied. That is, the gate voltages Vsp2, Vsp3 of the PMOS transistors SP2, SP3 are driven low and the gate voltages Vsn2, Vsn3 of NMOS transistors SN2, SN3 are driven high.

In the protective switching circuit 62 of the high-side operational amplifier 37B, just before the connection mode of output switching circuit 381 is switched from straight to cross (just before time t1), gate voltages Vn1, Vp1 that bring MOS switch 621 from the conductive state into the non-conductive state are supplied. That is, the gate voltage Vn1 of NMOS transistor N1 is driven low and the gate voltage Vp1 of PMOS transistor P1 is driven high. At the same time, gate voltages Vn2, Vp2 that bring MOS switch 622 from the non-conductive state into the conductive state are supplied. That is, the gate voltage Vn2 of NMOS transistor N2 is driven high and the gate voltage Vp2 of PMOS transistor P2 is driven low.

After a predetermined elapse of time from time t1, gate voltages Vn1, Vp1 that bring MOS switch 621 from the non-conductive state into the conductive state are supplied. That is, the gate voltage Vn1 of NMOS transistor N1 is driven high and the gate voltage Vp1 of PMOS transistor P1 is driven low. At the same time, gate voltages Vn2, Vp2 that bring MOS switch 622 from the conductive state into the non-conductive state are supplied. That is, the gate voltage Vn2 of NMOS transistor N2 is driven low and the gate voltage Vp2 of PMOS transistor P2 is driven high.

During the predetermined period from time t1 in which MOS switch 622 is in the conductive state, the power supply voltage VSS lower than the common power supply voltage VMM is applied to the anode of parasitic diode 70. This prevents parasitic diode 70 from being forward biased. More specifically, since the high-side operational amplifier 37B was outputting a gray-scale voltage of positive polarity to data line 31B through MOS switch 382 prior to time t1, the voltage level of data line 31B is high at time t1. Meanwhile, since the low-side operational amplifier 37A was outputting a gray-scale voltage of negative polarity to data line 31A through MOS switch 385 prior to time t1, the voltage level of data line 31A is low at time t1. After time t1, if the connection mode of output switching circuit 381 is switched to the cross mode, the output terminal NB of the high-side operational amplifier 37B is connected through MOS switch 384 to data line 31A, which is at a low voltage level, so a temporary steep drop occurs in the voltage level Vb at the output terminal NB, as shown in FIG. 8. This causes the voltage level at the cathode of parasitic diode 70 also to drop, but before the voltage level at the cathode drops, the anode of parasitic diode 70 is electrically disconnected from the VMM power supply line by MOS switch 621 (PMOS transistor P1 and NMOS transistor N1) and is connected to the power supply voltage VSS by MOS switch 622 (PMOS transistor P2 and NMOS transistor N2). Accordingly, the forward biasing of parasitic diode 70 is reliably prevented.

Similarly, in the protective switching circuit 67 of the low-side operational amplifier 37A, just before the connection mode of the output switching circuit 381 is switched from straight to cross (just before time t1), gate voltages Vn3, Vp3 bring MOS switch 671 from the conductive state into the non-conductive state are supplied. That is, the gate voltage Vn3 of NMOS transistor N3 is driven low and the gate voltage Vp3 of PMOS transistor P3 is driven high. At the same time, gate voltages Vn4, Vp4 that bring MOS switch 672 from the non-conductive state into the conductive state are supplied. That is, the gate voltage Vn4 of NMOS transistor N4 is driven high and the gate voltage Vp4 of PMOS transistor P4 is driven low.

After the elapse of a predetermined time from time t1, gate voltages Vn3, Vp3 that bring MOS switch 671 from the non-conductive state into the conductive state are supplied. That is, the gate voltage Vn3 of NMOS transistor N3 is driven high and the gate voltage Vp3 of PMOS transistor P3 is driven low. At the same time, gate voltages Vn4, Vp4 that bring MOS switch 672 from the conductive state into the non-conductive state are supplied. That is, the gate voltage Vn4 of NMOS transistor N4 is driven low and the gate voltage Vp4 of PMOS transistor P4 is driven high.

During the predetermined period from time t1 in which MOS switch 672 is in the conductive state, the power supply voltage VDD higher than the common power supply voltage VMM is applied to the cathode of parasitic diode 71. This prevents parasitic diode 71 from being forward biased. More specifically, after time t1, if the connection mode of output switching circuit 381 is switched to the cross mode, the output terminal NA of the low-side operational amplifier 37A is connected through MOS switch 383 to data line 31B, which is at a high voltage level, causing a temporary steep rise in the voltage level Va at the output terminal NA, as shown in FIG. 8. This rise also causes the voltage level at the anode of parasitic diode 71 to rise, but before the voltage level at the anode rises, the cathode of parasitic diode 71 is electrically disconnected from the VMM power supply line by MOS switch 671 (PMOS transistor P3 and NMOS transistor N3) and is connected to the VDD power supply voltage by MOS switch 672 (PMOS transistor P4 and NMOS transistor N4). Accordingly, forward biasing of parasitic diode 71 is reliably prevented.

When the connection mode of the output switching circuit 381 is switched from cross to straight (at around time t2), as shown in the waveforms in FIG. 8, gate voltages Vsp2, Vsn2, Vsp3, Vsn3 that bring MOS switches 383, 384 from the conductive state into the non-conductive state are supplied. That is, the gate voltages Vsp2, Vsp3 of PMOS transistors SP2, SP3 are driven high and the gate voltages Vsn2, Vsn3 of NMOS transistors SN2, SN3 are driven low. At the same time, gate voltages Vsp1, Vsn1, Vsp4, Vsn4 that bring MOS switches 382, 385 from the non-conductive state into the conductive state are supplied. That is, the gate voltages Vsp1, Vsp4 of PMOS transistors SP1, SP4 are driven low and the gate voltages Vsn1, Vsn4 of NMOS transistors SN1, SN4 are driven high.

In the protective switching circuit 62 of the high-side operational amplifier 37B, just before the connection mode of the output switching circuit 381 is switched from cross to straight (just before time t2), gate voltages Vn1, Vp1 that bring MOS switch 621 from the conductive state into the non-conductive state are supplied. At the same time, gate voltages Vn2, Vp2 that bring MOS switch 622 from the non-conductive state into the conductive state are supplied.

After a predetermined elapse of time from time t2, gate voltages Vn1, Vp1 that bring MOS switch 621 from the non-conductive state into the conductive state are supplied. At the same time, gate voltages Vn2, Vp2 that bring MOS switch 622 from the conductive state into the non-conductive state are supplied.

During the predetermined period from time t2 in which MOS switch 622 is in the conductive state, the power supply voltage VSS lower than the common power supply voltage VMM is applied to the anode of parasitic diode 70. This prevents parasitic diode 70 from being forward biased. More specifically, since the high-side operational amplifier 37B was outputting a gray-scale voltage of positive polarity to data line 31A through MOS switch 384 prior to time t2, the voltage level of data line 31A is high at time t2. Meanwhile, since the low-side operational amplifier 37A was outputting a gray-scale voltage of negative polarity to data line 31B through MOS switch 383 prior to time t2, the voltage level of data line 31B is low at time t2. After time t2, if the connection mode of the output switching circuit 381 is switched to the straight mode, the output terminal NB of the high-side operational amplifier 37B is connected through MOS switch 382 to data line 31B, which is at a low voltage level, so the voltage level Vb at the output terminal NB temporarily drops steeply as shown in FIG. 8. This causes the voltage level at the cathode of parasitic diode 70 also to drop, but before the voltage level at the cathode drops, the anode of parasitic diode 70 is electrically disconnected from the VMM power supply line by MOS switch 621 (PMOS transistor P1 and NMOS transistor N1) and is connected to the power supply voltage VSS by MOS switch 622 (PMOS transistor P2 and NMOS transistor N2). Accordingly, forward biasing of parasitic diode 70 is reliably prevented.

Meanwhile, in the protective switching circuit 67 of the low-side operational amplifier 37A, just before the connection mode of output switching circuit 381 is switched from cross to straight (just before time t2), gate voltages Vn3, Vp3 that bring MOS switch 671 from the conductive state into the non-conductive state are supplied. At the same time, gate voltages Vn4, Vp4 that bring MOS switch 672 from the non-conductive state into the conductive state are supplied.

After the elapse of a predetermined time from time t2, gate voltages Vn3, Vp3 that bring MOS switch 671 from the non-conductive state into the conductive state are supplied. At the same time, gate voltages Vn4, Vp4 that bring MOS switch 672 from the conductive state into the non-conductive state are supplied.

During the predetermined period from time t2 in which MOS switch 672 is in the conductive state, the power supply voltage VDD higher than the common power supply voltage VMM is applied to the cathode of parasitic diode 71. This prevents parasitic diode 71 from being forward biased. More specifically, after time t2, when the connection mode of the output switching circuit 381 is switched to the straight mode, the output terminal NA of the low-side operational amplifier 37A is connected through MOS switch 385 to data line 31A, which is at a high voltage level, so a temporary steep rise occurs in the voltage level Va at the output terminal NA, as shown in FIG. 8. This rise also causes the voltage level at the anode of parasitic diode 71 to rise, but before the voltage level at the anode rises, the cathode of parasitic diode 71 is electrically disconnected from the VMM power supply line by MOS switch 671 (PMOS transistor P3 and NMOS transistor N3) and is connected to the power supply voltage VDD by MOS switch 672 (PMOS transistor P4 and NMOS transistor N4). Accordingly, forward biasing of parasitic diode 71 is reliably prevented.

As described above, when the voltage level of the output terminal NB of the high-side operational amplifier 37B is dropped by switching the connection of output terminal NB from one of the data lines 31B, 31A to the other, the anode of parasitic diode 70 is temporarily connected to the VSS power line by protective switching circuit 62, reliably preventing parasitic diode 70 from being forward biased. When the voltage level of the output terminal NA of the low-side operational amplifier 37A is raised by switching the connection of output terminal NA from one of the data lines 31B, 31A to the other, the cathode of parasitic diode 71 is temporarily connected to the VDD power line by protective switching circuit 67, reliably preventing parasitic diode 71 from being forward biased. Accordingly, excessive current flows through the parasitic diodes 70, 71 are prevented.

Figure 9:
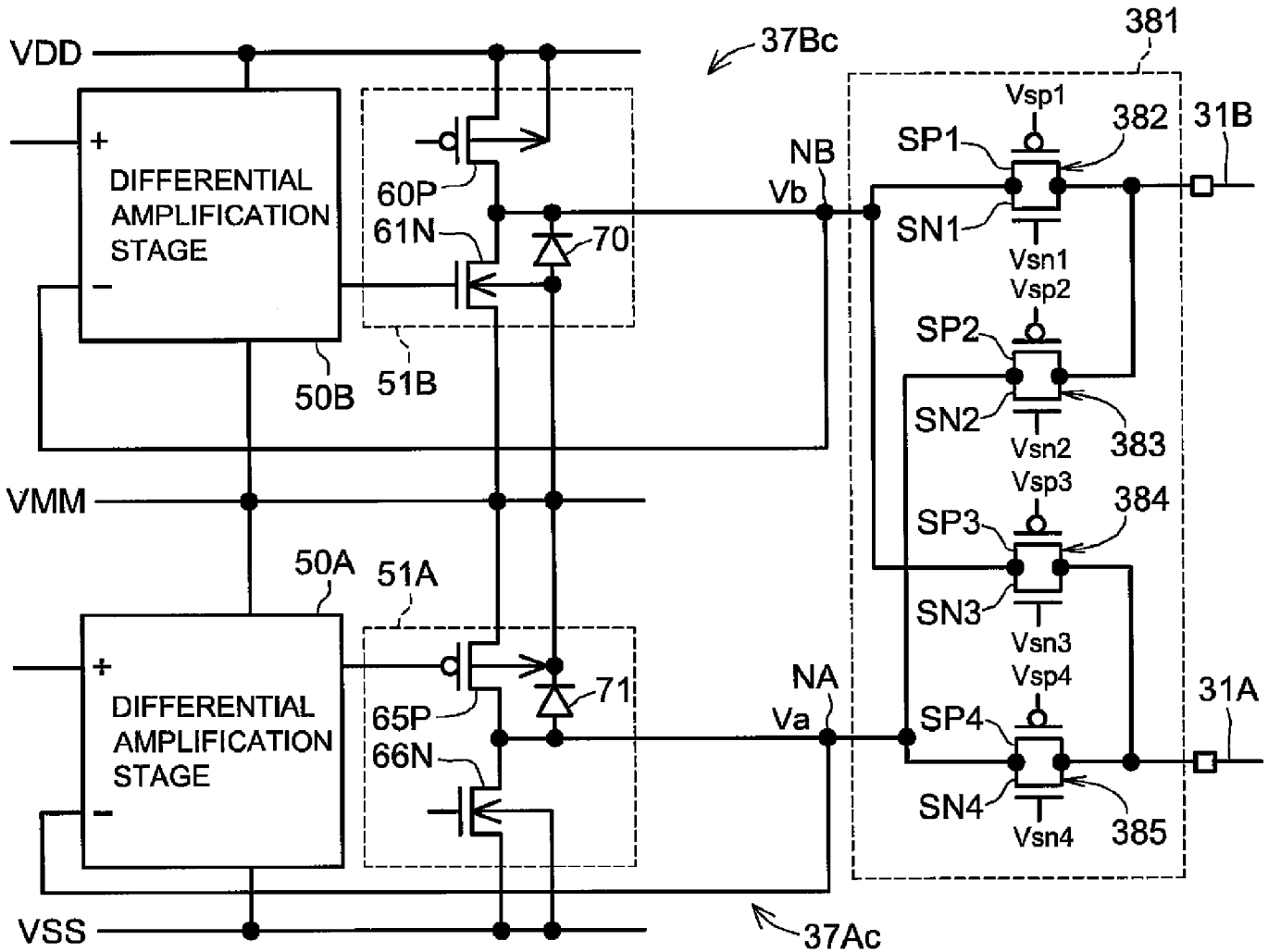
FIG. 9 schematically shows, as a comparative example, the circuit configuration of a pair of operational amplifiers without protective switching circuits.

The mechanism by which the low-side operational amplifier 37Ac and 37Bc are damaged when excessive currents flow through the parasitic diodes 70, 71 will be described below with reference to FIG. 9, which is substantially identical to in FIG. 7 except for having no protective switching circuits 62, 67.

As described above, when the connection mode of output switching circuit 381 is switched, the voltage level Vb at the output terminal NB of the high-side operational amplifier 37Bc drops steeply. During this period, if the voltage level Vb at the output terminal NB goes below the common power supply voltage VMM and a large forward bias is applied to parasitic diode 70, an npn parasitic bipolar transistor (including parasitic diode 70) in NMOS transistor 61N turns on and a phenomenon (bipolar action) occurs in which excessive current flows through the parasitic bipolar transistor. This excessive current may damage internal elements in the high-side operational amplifier 37Bc. Similarly, when the connection mode of output switching circuit 381 is switched, the voltage level Va at the output terminal NA of the low-side operational amplifier 37Ac rises steeply. During this period, if the voltage level Va at the output terminal NA exceeds the common power supply voltage VMM and a large forward bias is applied to parasitic diode 71, a pnp parasitic bipolar transistor (including parasitic diode 71) in PMOS transistor 65P turns on and bipolar action occurs in this parasitic bipolar transistor. The resulting excessive current may damage internal elements in the low-side operational amplifier 37Ac.

In contrast, when the connection mode of output switching circuit 381 in FIG. 7 is switched in the first embodiment of the invention, the parasitic diodes 70, 71 are not forward biased, so the potentially damaging bipolar action is prevented.

Second Embodiment

Next, a second embodiment of the invention will be described with reference to FIG. 10, which shows an exemplary configuration of a source driver 3M, and FIG. 11, which shows the schematic configuration of a low-side operational amplifier 37C and high-side operational amplifier 37D in the source driver 3M and the configuration of the corresponding output switching circuit 381.

Figure 10:
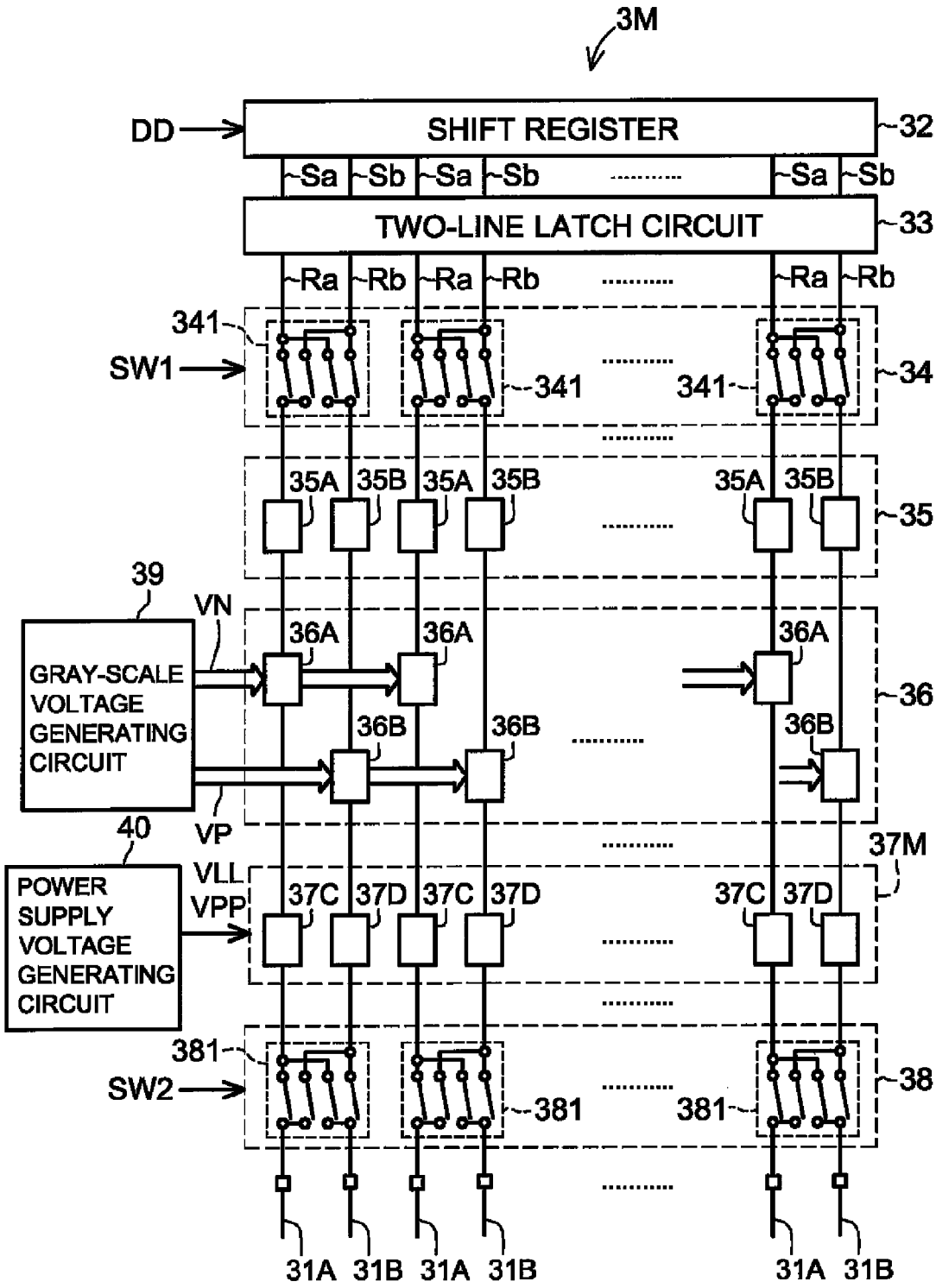
FIG. 10 schematically shows an exemplary circuit configuration of a source driver according to a second embodiment of the invention.

The source driver 3M in FIG. 10 is identical to the source driver 3 in FIG. 3 except for the internal configuration of the impedance conversion circuit 37M and the addition of a power supply voltage generating circuit 40. The low-side operational amplifiers 37C and high-side operational amplifiers 37D in the impedance conversion circuit 37M again function as voltage followers, but differ from the low-side operational amplifiers 37A and high-side operational amplifiers 37B in the first embodiment.

The power supply voltage generating circuit 40 generates power supply voltages VPP, VLL from any of the power supply voltages VDD, VSS, VMM. Power supply voltage VPP (=VMM+$\alpha$) is lower than the power supply voltage VDD and is higher than the common power supply voltage VMM by an amount $\alpha$. Power supply voltage VLL (=VMM−$\beta$) is higher than the power supply voltage VSS and is lower than the common power supply voltage VMM by an amount $\beta$. The values of $\alpha$ and $\beta$ are a design choice that may be made according to the characteristics of the operational amplifiers 37C, 37D.

Figure 11:
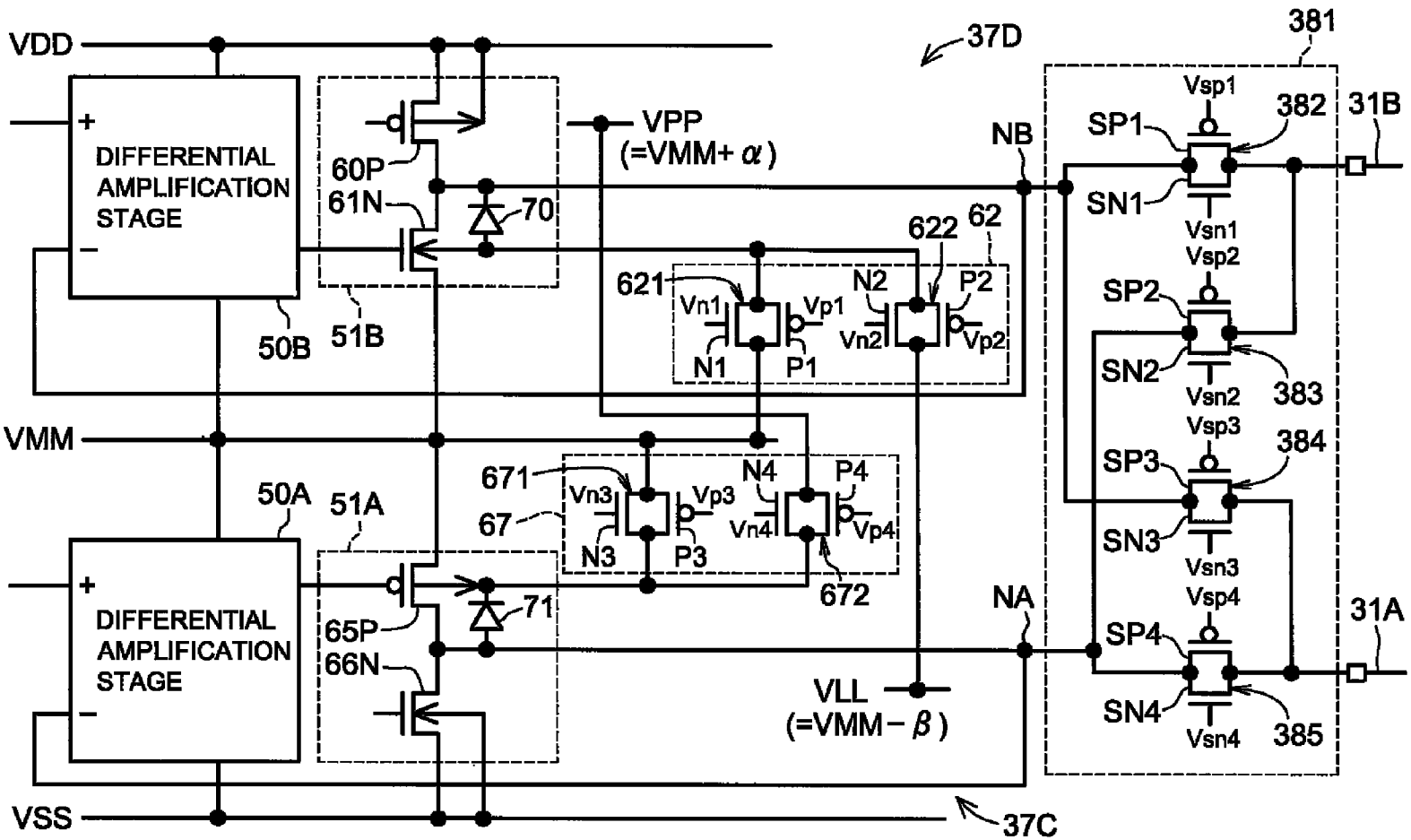
FIG. 11 schematically shows the circuit configuration of a pair of operational amplifiers and their output switching circuit in the source driver in FIG. 10.

Referring to FIG. 11, the low-side operational amplifier 37C includes the same differential amplification stage 50A, output amplification stage 51A, and protective switching circuit 67 as in the first embodiment, but one main terminal of MOS switch 672 in protective switching circuit 67 is connected to the VPP power supply line instead of the VDD power supply line. Similarly, the high-side operational amplifier 37D includes the same differential amplification stage 50B, output amplification stage 51B, and protective switching circuit 62 as in the first embodiment, but one main terminal of MOS switch 622 in protective switching circuit 62 is connected to the VLL power supply line instead of the VSS power supply line.

The replacement of operational amplifiers 37A, 37B in the first embodiment with operational amplifiers 37C, 37D in the second embodiment does not change the switching of the connection modes. The control signals shown in FIG. 8 are supplied to output switching circuit 381, protective switching circuit 62, and protective switching circuit 67.

In the second embodiment, as in the first embodiment, the voltage level at the output terminal NB of the high-side operational amplifier 37D drops temporarily when its connection is switched from one of the data lines 31A, 31B to the other. During this period, since a power supply voltage VLL lower than the common power supply voltage VMM is applied to the anode of parasitic diode 70 for a predetermined period by MOS switch 622 in protective switching circuit 62, forward biasing of parasitic diode 70 is prevented. In addition, since the power supply voltage VLL applied to the anode of parasitic diode 70 is higher than VSS, the time needed for charging and discharging the back gate of NMOS transistor 61N can be reduced as compared with the first embodiment.

Similarly, the voltage level at the output terminal NA of the low-side operational amplifier 37C rises temporarily when its connection is switched from one of the data lines 31B, 31A to the other. During this period, since a power supply voltage VPP higher than the common power supply voltage VMM is applied to the cathode of parasitic diode 71 for a predetermined period by MOS switch 672 in protective switching circuit 67, forward biasing of parasitic diode 71 is prevented. In addition, since the power supply voltage VPP applied to the cathode of parasitic diode 71 is lower than VDD, the time needed for charging and discharging the back gate of PMOS transistor 65P can be reduced as compared with the first embodiment.

As described above, when the connection mode of output switching circuit 381 is switched, the back gates of NMOS transistor 61N and PMOS transistor 65P in operational amplifiers 37C and 37D are charged and discharged in less time than in the first embodiment. This enables the current driving capabilities of the output amplification stages 51A, 51B to recover more quickly than in the first embodiment. The power consumption of the operational amplifiers 37C, 37D is also reduced.

Variations

The preceding embodiments of the invention and the illustrative drawings are exemplary but not limiting. For example, the display pixel DP may be an element having a capacitive load other than a liquid crystal element.

The configurations of the low-side operational amplifiers 37A, 37C and high-side operational amplifiers 37B, 37D of the first and second embodiments may be changed to any configuration in which a parasitic bipolar transistor including a parasitic diode is formed between the VMM power supply line and one or both of the output terminals NA, NB.

Figure 12:
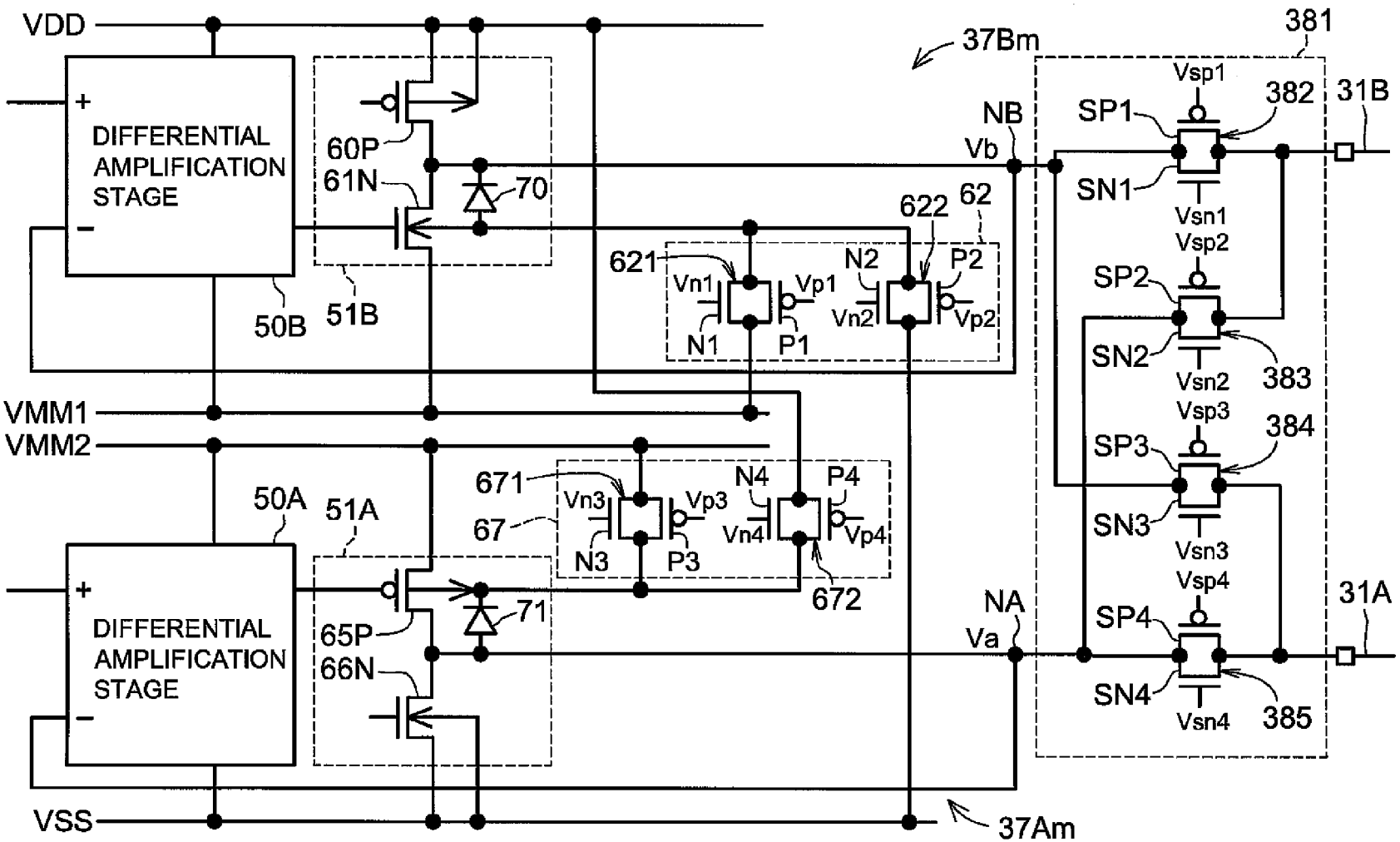
FIG. 12 schematically shows the circuit configuration of a pair of operational amplifiers in an exemplary variation of the first embodiment.

The low-side operational amplifiers 37A, 37C and high-side operational amplifiers 37B, 37D need not use the same common power supply voltage VMM. The high-side operational amplifiers 37B, 37D may be powered by power supply voltages VMM1 and VDD and the low-side operational amplifiers 37A, 37C by power supply voltages VSS and VMM2, where VDD>VMM1>VMM2>VSS and VMM1≠VMM2. The high-side operational amplifier 37Bm and a low-side operational amplifier 37Am shown in FIG. 12 are an example of this type of configuration.

The low-side operational amplifiers 37A, 37C and the high-side operational amplifiers 37B, 37D may be rail-to-rail operational amplifiers with input and output voltage ranges equal to their full power supply voltage ranges. The differential amplification stages 50A, 50B may have circuit configurations of either the sink type or source type.

Those skilled in the art will recognize that further variations are possible within the scope of the invention, which is defined in the appended claims.

What is claimed is:

1. A driving circuit for driving a display panel having a plurality of scan lines, a plurality of data lines spaced apart from the plurality of scan lines but arrayed to cross the plurality of scan lines, and a plurality of capacitive loads formed in respective areas neighboring crossings of the scan lines and the data lines, the driving circuit comprising:

a first operational amplifier powered by a first power supply voltage and a second power supply voltage lower than the first power supply voltage, having an output terminal for output of an analog voltage with a direct current voltage component of positive polarity;

a second operational amplifier powered by a third power supply voltage and a fourth power supply voltage lower than the third power supply voltage, having an output terminal for out put of an analog voltage with a direct current voltage component of negative polarity; and an output switching circuit for connecting the output terminal of the first operational amplifier to a first data line among the plurality of data lines and connecting the output terminal of the second operational amplifier to a second data line among the plurality of data lines, then interchanging connections so that the output terminal of the first operational amplifier is connected to the second data line and the output terminal of the second operational amplifier is connected to the first data line;

wherein the first operational amplifier includes a first parasitic diode having an anode connected to a power line supplying the second power supply voltage and a cathode connected to the output terminal of the first operational amplifier, and a first protective switching circuit for connecting the anode of the first parasitic diode to a first voltage supply line supplying a voltage lower than the second supply voltage when the output switching circuit switches the connection of the output terminal of the first operational amplifier from the first data line to the second data line.

2. The driving circuit of claim 1, wherein after connecting the anode of the first parasitic diode temporarily to the first voltage supply line when the output switching circuit switches the connection of the output terminal of the first operational amplifier from the first data line to the second data line, the first protective switching circuit electrically disconnects the anode of the first parasitic diode from the first voltage supply line.

3. The driving circuit of claim 1, wherein the first parasitic diode is formed by a pn junction between a back gate of an n-channel field effect transistor and a source or drain of the n-channel field effect transistor.

4. The driving circuit of claim 3, wherein the first protective switching circuit:

connects the back gate of the n-channel field effect transistor to the power line supplying the second power supply voltage while the analog voltage output from the first operational amplifier is being supplied through the output switching circuit to the first data line; and electrically disconnects the back gate of the n-channel field effect transistor from the power line supplying the second power supply voltage when the output switching circuit switches the connection of the output terminal of the first operational amplifier from the first data line to the second data line.

5. The driving circuit of claim 1, wherein the first voltage supply line supplies the fourth power supply voltage.

6. The driving circuit of claim 1, wherein the first voltage supply line supplies a voltage higher than the fourth power supply voltage.

7. The driving circuit of claim 1, wherein the second operational amplifier includes:

a second parasitic diode having a cathode connected to a power line supplying the third power supply voltage and an anode connected to the output terminal of the second operational amplifier; and a second protective switching circuit for connecting the cathode of the second parasitic diode to a second voltage supply line supplying a voltage higher than the third supply voltage when the output switching circuit switches the connection of the output terminal of the second operational amplifier from the second data line to the first data line.

a first operational amplifier powered by a first power supply voltage and a second power supply voltage lower than the first power supply voltage, having an output terminal for output of an analog voltage with a direct current voltage component of positive polarity;

a second operational amplifier powered by a third power supply voltage and a fourth power supply voltage lower than the third power supply voltage, having an output terminal for output of an analog voltage with a direct current voltage component of negative polarity; and an output switching circuit for connecting the output terminal of the first operational amplifier to a first data line among the plurality of data lines and connecting the output terminal of the second operational amplifier to a second data line among the plurality of data lines, then interchanging connections so that the output terminal of the first operational amplifier is connected to the second data line and the output terminal of the second operational amplifier is connected to the first data line;

wherein the second operational amplifier includes a second parasitic diode having a cathode connected to a power line supplying the third power supply voltage and an anode connected to the output terminal of the second operational amplifier, and a second protective switching circuit for connecting the cathode of the second parasitic diode to a second voltage supply line supplying a voltage higher than the third supply voltage when the output switching circuit switches the connection of the output terminal of the second operational amplifier from the second data line to the first data line.

8. The driving circuit of claim 7, wherein after connecting the cathode of the second parasitic diode temporarily to the second voltage supply line when the output switching circuit switches the connection of the output terminal of the second operational amplifier from the second data line to the first data line, the second protective switching circuit electrically disconnects the cathode of the second parasitic diode from the second voltage supply line.

9. The driving circuit of claim 7, wherein the second parasitic diode is formed by a pn junction between a back gate of a p-channel field effect transistor and a source or drain of the p-channel field effect transistor.

10. The driving circuit of claim 9, wherein the second protective switching circuit:

connects the back gate of the p-channel field effect transistor to the power line supplying the third power supply voltage while the analog voltage output from the second operational amplifier is being supplied through the output switching circuit to the second data line; and electrically disconnects the back gate of the p-channel field effect transistor from the power line supplying the third power supply voltage when the output switching circuit switches the connection of the output terminal of the second operational amplifier from the second data line to the first data line.

11. The driving circuit of claim 7, wherein the second voltage supply line supplies the first power supply voltage.

12. The driving circuit of claim 7, wherein the second voltage supply line supplies a voltage lower than the first power supply voltage.

13. The driving circuit of claim 1, wherein the second power supply voltage and the third power supply voltage are an identical common power supply voltage.

14. A display apparatus including the driving circuit of claim 1.

15. The display apparatus of claim 14, wherein the capacitive loads are liquid crystal display elements each including a liquid crystal layer disposed between a pixel electrode and an opposing electrode, the analog voltage with the direct current voltage component of positive or negative polarity being supplied to the pixel electrode.

16. A driving circuit for driving a display panel having a plurality of scan lines, a plurality of data lines spaced apart from the plurality of scan lines but arrayed to cross the plurality of scan lines, and a plurality of capacitive loads formed in respective areas neighboring crossings of the scan lines and the data lines, the driving circuit comprising:

a first operational amplifier powered by a first power supply voltage and a second power supply voltage lower than the first power supply voltage, having an output terminal for output of an analog voltage with a direct current voltage component of positive polarity;

a second operational amplifier powered by a third power supply voltage and a fourth power supply voltage lower than the third power supply voltage, having an output terminal for output of an analog voltage with a direct current voltage component of negative polarity; and an output switching circuit for connecting the output terminal of the first operational amplifier to a first data line among the plurality of data lines and connecting the output terminal of the second operational amplifier to a second data line among the plurality of data lines, then interchanging connections so that the output terminal of the first operational amplifier is connected to the second data line and the output terminal of the second operational amplifier is connected to the first data line;

wherein the second operational amplifier includes a second parasitic diode having a cathode connected to a power line supplying the third power supply voltage and an anode connected to the output terminal of the second operational amplifier, and a second protective switching circuit for connecting the cathode of the second parasitic diode to a second voltage supply line supplying a voltage higher than the third supply voltage when the output switching circuit switches the connection of the output terminal of the second operational amplifier from the second data line to the first data line.

17. The driving circuit of claim 16, wherein the second power supply voltage and the third power supply voltage are an identical common power supply voltage.

18. A display apparatus including the driving circuit of claim 16.

19. The display apparatus of claim 18, wherein the capacitive loads are liquid crystal display elements each including a liquid crystal layer disposed between a pixel electrode and an opposing electrode, the analog voltage with the direct current voltage component of positive or negative polarity being supplied to the pixel electrode.

* * * * *